US009821179B2

(12) United States Patent
Kristensen

(10) Patent No.: US 9,821,179 B2
(45) Date of Patent: Nov. 21, 2017

(54) SPRAY HEAD FOR UNIFORM FLUID DISTRIBUTION

(75) Inventor: Steen Gaardsted Kristensen, Nordborg (DK)

(73) Assignee: Danfoss Semco A/S, Odense C (DK)

( * ) Notice: Subject to any disclaimer, the term of this patent is extended or adjusted under 35 U.S.C. 154(b) by 1955 days.

(21) Appl. No.: 12/442,212

(22) PCT Filed: Sep. 20, 2007

(86) PCT No.: PCT/DK2007/000412

§ 371 (c)(1),
(2), (4) Date: Jun. 18, 2009

(87) PCT Pub. No.: WO2008/034445

PCT Pub. Date: Mar. 27, 2008

(65) Prior Publication Data

US 2010/0025051 A1 Feb. 4, 2010

(30) Foreign Application Priority Data

Sep. 22, 2006 (DK) ..... 2006 01227

(51) Int. Cl.
*A62C 31/00* (2006.01)
*A62C 31/05* (2006.01)
*B05B 1/14* (2006.01)

(52) U.S. Cl.
CPC ..... *A62C 31/05* (2013.01); *B05B 1/14* (2013.01)

(58) Field of Classification Search
CPC ..... A62C 31/05
(Continued)

(56) References Cited

U.S. PATENT DOCUMENTS 2,334,395 A 11/1943 Dowell et al.
2,647,800 A * 8/1953 Burnam et al. ..... 239/543
(Continued)

FOREIGN PATENT DOCUMENTS

DE 203 18 317 U1 3/2005
EP 1 413 333 A1 4/2004
(Continued)

OTHER PUBLICATIONS

International Search Report for Serial No. PCT/DK2007/000412 dated Nov. 20, 2007.
"Lechler Vollkegeldusen" pp. 3.1-3.14.

*Primary Examiner* — Viet Le
(74) *Attorney, Agent, or Firm* — McCormick, Paulding & Huber LLP

(57) ABSTRACT

The present invention relates to a spray head for effective fire fighting. The spray head according to the present invention provides a uniform distribution of a fluid, such as pressurized water, over a relatively large area. To achieve this the spray head comprises a body defining a center axis and further comprising a fixation structure for fixing the spray head to a fluid supply system, a fluid inlet, a plurality of outlet nozzles arranged around the center axis, and a flow path between the inlet and the nozzles, wherein a first set of nozzles are located at a larger radial distance from the center axis than a second set of nozzles, and wherein the second set of nozzles are located at a larger radial distance from the center axis than a third set of nozzles, and wherein the nozzles comprise an essentially identical expansion passage section. The present invention further relates to method for providing a uniform fluid distribution.

5 Claims, 4 Drawing Sheets

Figure 1A:
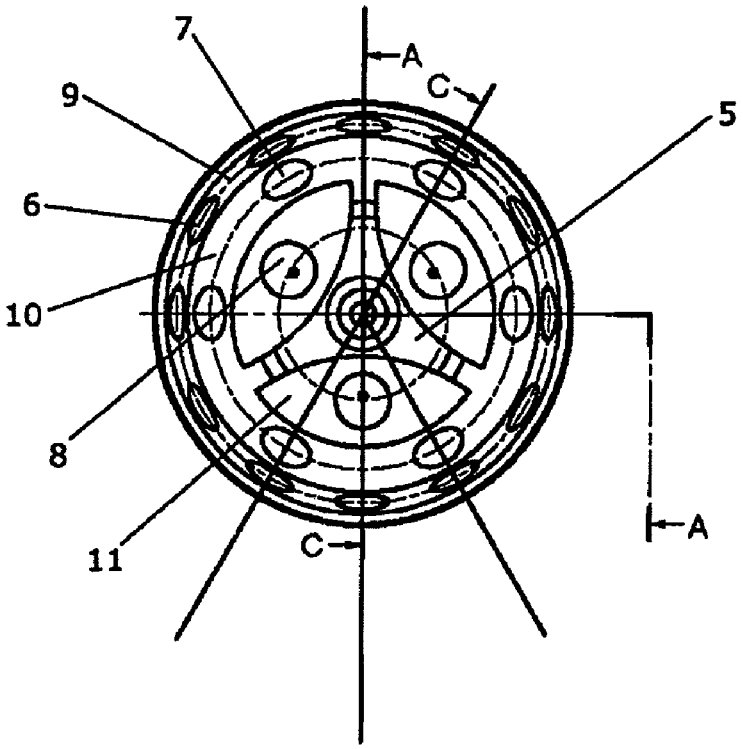

(58) Field of Classification Search
USPC ..... 239/548, 556, 543, 106, 544, 14, 2
See application file for complete search history.

(56) References Cited

U.S. PATENT DOCUMENTS

| | | | | | |
|---|---|---|---|---|---|
| 2,726,897 | A | * | 12/1955 | Dupont | 239/11 |
| 2,813,753 | A | * | 11/1957 | Roberts | 239/271 |
| 3,226,034 | A | * | 12/1965 | Helman | 239/316 |
| 3,744,723 | A | * | 7/1973 | Davis | 239/543 |
| 3,838,815 | A | * | 10/1974 | Rice | 239/14.2 |
| 5,392,993 | A | * | 2/1995 | Fischer | 239/522 |
| 5,653,391 | A | * | 8/1997 | Inamura et al. | 239/543 |
| 5,857,623 | A | * | 1/1999 | Miller et al. | 239/252 |
| 6,318,474 | B1 | * | 11/2001 | Sundholm | 169/37 |
| 6,375,757 | B2 | * | 4/2002 | Gazewood | 134/24 |
| 2002/0179307 | A1 | | 12/2002 | Schmidt et al. | |
| 2005/0011652 | A1 | | 1/2005 | Hua | |

FOREIGN PATENT DOCUMENTS

| | | | |
|---|---|---|---|
| EP | 1413333 | A1 | 4/2004 |
| FR | 2808227 | A1 | 11/2001 |
| WO | 98/04322 | | 2/1998 |
| WO | WO 98/04322 | A1 | 2/1998 |

* cited by examiner

SPRAY HEAD FOR UNIFORM FLUID DISTRIBUTION

CROSS REFERENCE TO RELATED APPLICATION

This application is entitled to the benefit of and incorporates by reference essential subject matter disclosed in International Patent Application No. PCT/DK2007/000412 filed on Sep. 20, 2007 and Danish Patent Application No. 2006 01227 filed Sep. 22, 2006.

FIELD OF THE INVENTION

The present invention relates to a spray head for uniform fluid distribution. The fluid to be distributed, such as for example water, is passed through a number of outlet nozzles under high pressure, such as around 100 bar. In order to obtain the uniform distribution of for example water the nozzles are arranged in groups where each group is arranged in a circumferential manner around a centre axis of the spray head. Furthermore, the groups of nozzles are angled differently relative to the centre axis of the spray head.

BACKGROUND OF THE INVENTION

Numerous implementations of spray heads for fire fighting systems have been suggested in the patent literature.

For example, EP 1 413 333 discloses a spray head having nozzles of various dimensions arranged in a semi-sphere. According to EP 1 413 333 nozzles of relatively small dimensions are arranged to fight fire occurring at a relatively large radial distance from the spray head whereas larger, and more downwardly oriented nozzles, are arranged to fight fire below the spray head. The nozzles of relatively small dimension are cylindrical in shape, whereas the downwardly oriented nozzles have a cylindrically shaped initial section being in fluidic communication with an essentially conically shaped outlet section.

U.S. Pat. No. 6,318,474 discloses a spray head having angled outlet nozzles arranged in a sidewall portion of the spray head body. The nozzles suggested in U.S. Pat. No. 6,318,474 are angled to a centre axis of the spray head with an angle of up to 120 degrees. Each of the angled nozzles has a relatively narrow cylindrically shaped initial section being in fluidic communication with a broader cylindrically shaped outlet section. The spray head of U.S. Pat. No. 6,318,474 further comprises a number of downwardly oriented, and cylindrically shaped, outlet nozzles.

It is a disadvantage of the spray heads suggested in EP 1 413 333 and U.S. Pat. No. 6,318,474 that a uniform fluid distribution, and thereby an effective fire fighting system, cannot be achieved.

It is a further disadvantage of especially the spray head suggested in U.S. Pat. No. 6,318,474 that the amount of fluid downwardly directed is relatively reduced. Thus, the spray head suggested in U.S. Pat. No. 6,318,474 is less effective to fight fire immediately below the position of the spray head.

Finally, the spray heads suggested in the above-mentioned documents are rather limited in the sense that the fluid is distributed over a limited area around the spray heads. As a consequence, the number of required spray heads to establish an effective fire fighting system becomes unnecessary large, thereby increasing the costs of the fire fighting system unnecessary.

It may be seen as an object of the present invention to provide a spray head that offers an effective fire extinguishing performance by ensuring uniform fire extinguishing around the spray head and when more spray heads are used increase the individual distance between the spray heads.

SUMMARY OF THE INVENTION

The above-mentioned object is complied with by providing, in a first aspect a spray head comprising

- a body defining a centre axis and further comprising a fixation structure for fixing the spray head to a fluid supply system,
- a fluid inlet,
- a plurality of outlet nozzles arranged around the centre axis, and
- a flow path between the inlet and the nozzles, wherein a first set of nozzles are located at a larger radial distance from the centre axis than a second set of nozzles, and wherein the second set of nozzles are located at a larger radial distance from the centre axis than a third set of nozzles, and wherein the nozzles comprise an essentially identical expansion passage section.

The spray head according to the present invention is intended for forming part of a fire fighting system comprising a plurality of spray heads distributed over a ceiling of a room, a complete building, on a ship both outside and inside and inside installations for example electrical installations. The spray head is adapted to form an end part of a fluid conduit, such as a high pressure water conduit. By high pressure is meant that the water pressure may be as high as 100, 200 or 300 bar when the spray head is active, i.e. when water is distributed by the spray head. Preferably, the fixation structure surrounds the inlet.

Activation of the spray head may be provided by various means. For example, the spray head may have an integrated activation arrangement, such as a glass ampoule, which bursts when the temperature around the spray head reaches a predetermined temperature for that specific glass ampoule which normally reaches from 55° C. to 350° C. Before the spray head is activated, the water pressure in the water conduit may be for example 10 bar. Upon activation of the spray head the water pressure in the water conduit is slightly reduced due to the opening of the spray head. This lowered water pressure may be detected by a pressure sensor in the fire fighting system, which in response to the detected pressure drop, increases the water pressure to a higher level, such as 100 bar.

Regarding the configuration of the spray head the second set of nozzles may be located at a larger radial distance from the centre axis than a third set of nozzles. The radial distance from the centre axis to a given outlet nozzle is the radial distance from the centre axis to a centre point in the opening of the expansion passage section of the given nozzle.

The second and third set of nozzles may comprise an essentially identical expansion passage section. Each nozzle may comprise an initial passage section with a first cross sectional size, the initial passage section being in fluid communication with the expansion passage section comprising a second cross sectional size. The second cross sectional size may be larger than the first cross sectional size. The initial passage section may take an essentially cylindrical shape having a diameter in the range 0.5-2.5 mm. The expansion passage section may take an essentially conical shape having an opening angle in the range 40-80°, such as 50-70°, such as around 60°. The exterior opening of the expansion passage section obviously depends on the opening angle of the conical shape. As an example, the exterior opening for an expansion passage section having an opening angle of 60° is approximately 4.5 mm.

In order for, for example, water to escape from the spray head a sharp end of the conically shaped expansion passage section may be oriented towards, and being in fluidic communication with, the essentially cylindrically shaped initial passage section.

The body of the spray head according to the present invention may comprise at least a first and a second circumferential surface part, the first and second circumferential surface parts forming first and second angles, respectively, to the centre axis. Preferably, the first set of nozzles are arranged in the first circumferential surface part, and the second set of nozzles are arranged in the second circumferential surface part. The first set of nozzles may comprise a larger number of nozzles than the second set of nozzles. For example, the first set of nozzles may comprise 12 nozzles, whereas the second set of nozzles may comprise 6 nozzles. Obviously, these numbers may be chosen differently.

In a similar manner, the second set of nozzles may comprise a larger number of nozzles than the third set of nozzles. For example, the second set of nozzles may comprise 6 nozzles, whereas the third set of nozzles may comprise 3 nozzles. Obviously, these numbers may be chosen differently. The third set of nozzles may be arranged in an exterior surface part of the body, the exterior surface part forming a third angle to the centre axis.

The first angle formed between the first circumference surface part and the centre axis may be in the range 5-25°, such as in the range 10-20°, such as approximately 15°. The second angle formed between the second circumference surface part and the centre axis may be in the range 20-50°, such as in the range 25-45°, such as approximately 34°. The third angle formed between the exterior surface part with the third set of nozzles arranged therein and the centre axis may be in the range 80-100°, such as in the range 85-95°, such as approximately 90°—i.e. the exterior surface part may be essentially perpendicular to the centre axis. Thus, the first angle may be smaller than the second angle which may be smaller than the third angle.

In a second aspect, the present invention relates to a spray head comprising

- a body defining a centre axis and further comprising a fixation structure for fixing the spray head to a fluid supply system,
- a fluid inlet,
- a plurality of outlet nozzles arranged around a centre axis, and
- a flow path between the inlet and the nozzles, wherein the plurality of nozzles are arranged to provide a substantially uniform distribution of the fluid in a plane substantially perpendicular to the centre axis of the body when fluid is allowed to escape through the nozzles.

The plurality of nozzles may comprise a first and a second set of nozzles, wherein each of the nozzles of the first set forms a first escaping angle to the centre axis, and wherein each of the nozzles of the second set forms a second escaping angle to the centre axis, the first and second escaping angles being of different size. For example, the first escaping angle may be larger than the second escaping angle.

The spray head according to the second aspect of the present invention may further comprising a third set of nozzles wherein each of the nozzles of the third set forms a third escaping angle to the centre axis in such a way that the second escaping angle may be larger than the third escaping angle.

The first escaping angle may be in the range 65-85°, such as in the range 70-80°, such as approximately 75°. The second escaping angle may be in the range 40-70°, such as in the range 45-65°, such as approximately 56°. The third escaping angle may be in the range 1-10°, such as approximately 5°. Thus, the first escaping angle may be larger than the second escaping angle which may be larger than the third escaping angle.

As with the first aspect of the present invention the first set of nozzles may be located at a larger radial distance from the centre axis than the second set of nozzles. Similarly, the second set of nozzles may be located at a larger radial distance from the centre axis than the third set of nozzles.

The plurality of nozzles may comprise an essentially identical expansion passage section, said expansion passage section being in fluidic communication with an initial passage section of the nozzles, the initial passage section having a smaller cross sectional area than any cross sectional area of the expansion section area. The initial passage section may take an essentially cylindrical shape. The expansion passage section may take an essentially conical shape. A sharp end of the conically shaped expansion passage section is oriented towards the essentially cylindrically shaped initial passage section. The dimensions and shapes of the essentially cylindrically shaped initial passage and the conically shaped expansion passage section may be similar as mentioned in connection with the first aspect of the present invention.

In a third aspect, the present invention relates to a spray head comprising,

- a body defining a centre axis and further comprising a fixation structure for fixing the spray head to a fluid supply system,
- a fluid inlet,
- a first, a second and a third outlet nozzle, and
- a flow path between the inlet and the nozzles, wherein the first nozzle forms a first escaping angle to the centre axis of the spray head, and wherein the second nozzle forms a second escaping angle to the centre axis, and wherein the third nozzle forms a third escaping angle to the centre axis, the first, second and third escaping angles being of different size.

As with the second aspect of the present invention the first escaping angle may be larger than the second escaping angle, and the second escaping angler may be larger than the third escaping angle. Thus, the first escaping angle may be in the range 65-85°, such as in the range 70-80°, such as approximately 75°. The second escaping angle may be in the range 40-70°, such as in the range 45-65°, such as approximately 56°. The third escaping angle may be essentially parallel to the centre axis.

The first, second and third nozzles may comprise an essentially identical expansion passage section, said expansion passage section being in fluidic communication with an initial passage section of the nozzles, the initial passage section having a smaller cross sectional area than any cross sectional area of the expansion section area. The initial passage sections may take an essentially cylindrical shape, and the expansion passage sections may take an essentially conical shape. A sharp end of the conically shaped expansion passage section may be oriented towards the essentially cylindrically shaped initial passage section. The dimensions and shapes of the essentially cylindrically shaped initial passage and the conically shaped expansion passage section may be similar as mentioned in connection with the first aspect of the present invention In a fourth aspect, the present invention relates to a method for providing uniform distribution of a fluid, such as water, the method comprising the steps of: providing a spray head comprising, a body defining a centre axis and further comprising a fixation structure for fixing the spray head to a fluid supply system, a fluid inlet, a plurality of outlet nozzles arranged around the centre axis, and a flow path between the inlet and the nozzles, wherein the plurality of nozzles are arranged to provide a substantially uniform distribution of the fluid around the spray head when fluid is allowed to escape through the nozzles. The spray head is preferably configured as mentioned in connection with the first aspect of the present invention.

In a fifth and sixth aspect of the present invention, the present invention relates to a method for providing uniform distribution of a fluid, such as water, the method comprising the steps of providing spray heads according to the second and third aspects of the present invention, respectively.

BRIEF DESCRIPTION OF THE INVENTION

Figure 2A:
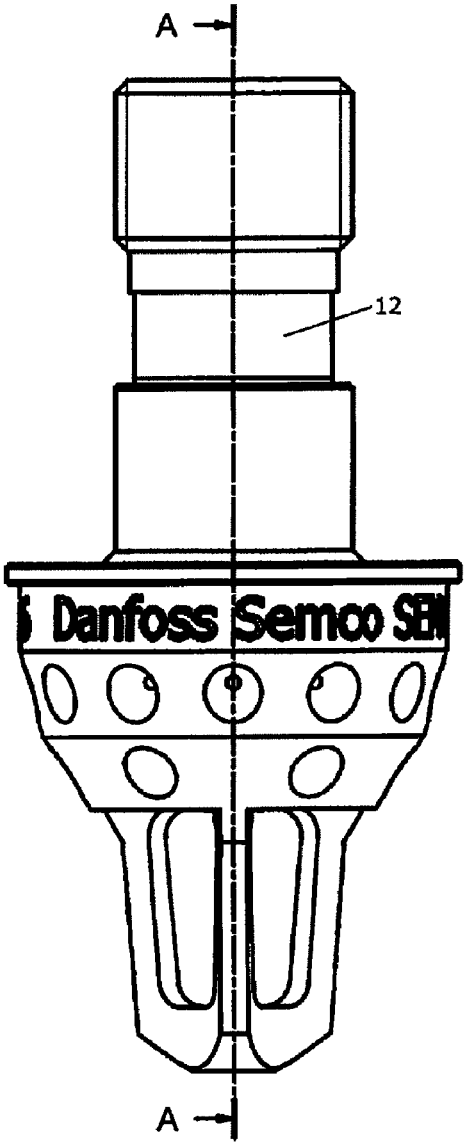
Figure 2B:
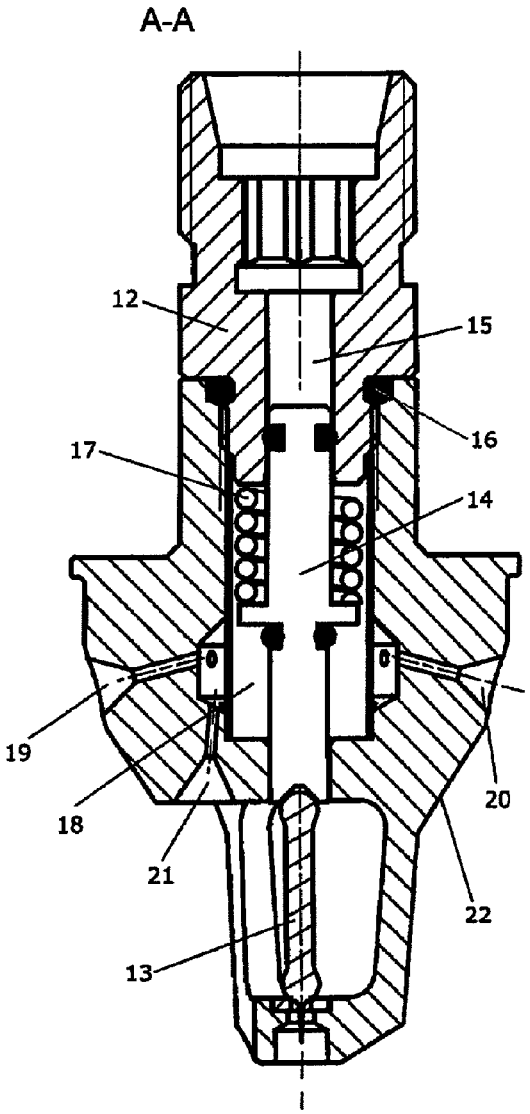
Figure 3A:
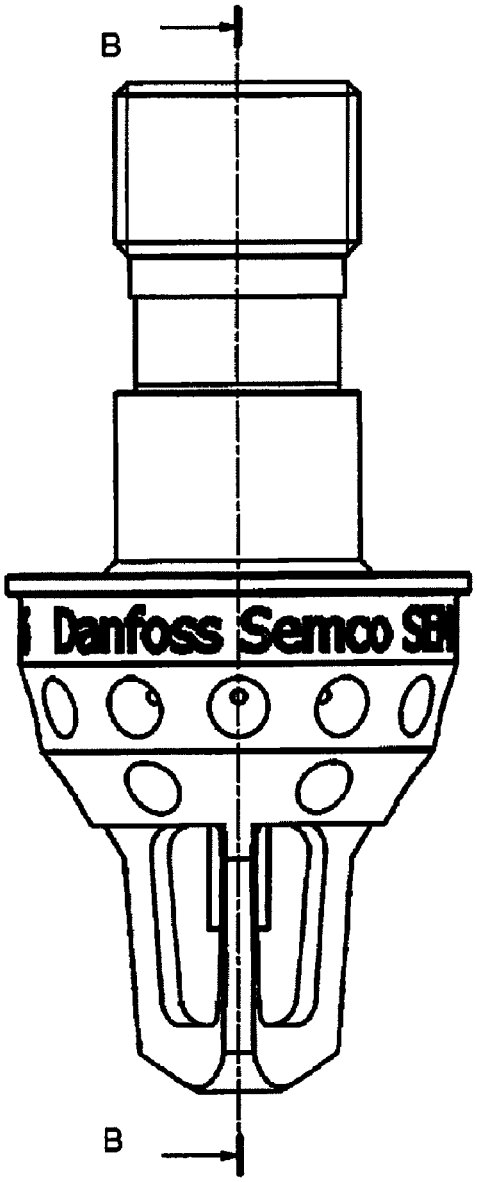
Figure 3B:
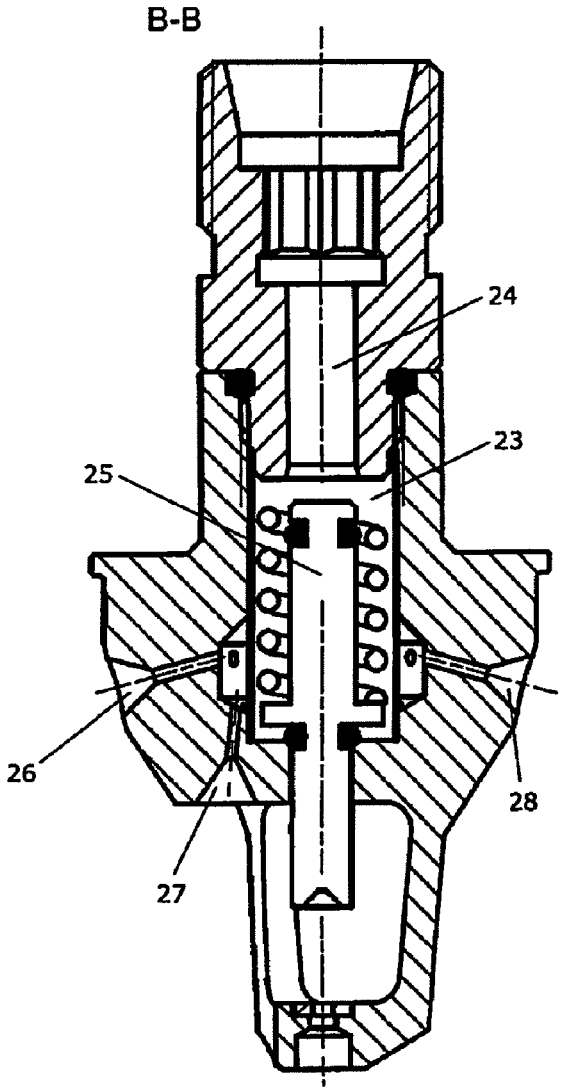

The present invention will now be described in further details with reference to the accompanying where FIG. 1 shows a bottom and a side view of the spray head according to the present invention, FIG. 2 shows a side view and a cross-sectional view of a closed spray head, FIG. 3 shows a side view and a cross-sectional view of an open spray head, and FIG. 4 shows cross-sectional views of different regions of the spray head.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its broadest aspect the present invention relates to a fire fighting spray head capable of distributing fluid in a uniform manner. By uniform is meant that an area is provided with an essentially evenly distributed amount of fluid, such as water. This is done with a sufficiently amount of fluid to control or extinguish the fire. In addition, the fire fighting spray head of the present invention is capable of distributing a fluid, such as water over a larger area compared to conventional spray heads whereby the number of required spray heads forming a fire fighting system can be significantly reduced. The spray head of the present invention can cover an area of about 25 square meters.

Figure 1B:
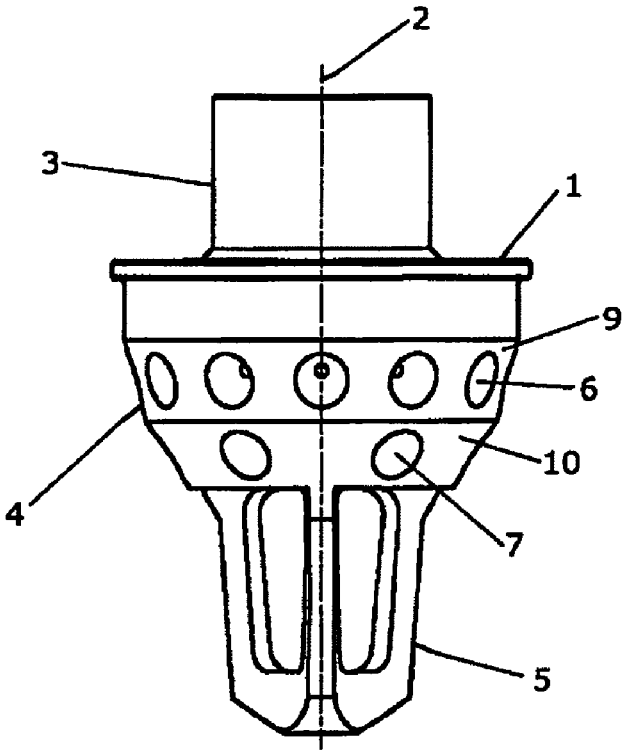

Referring now to FIG. 1 a bottom view, FIG. 1*a*, and a side view, FIG. 1*b*, of a spray head according to the present invention is depicted. The spray head comprises a body 1 defining a centre axis 2. The body 1 may be seen as comprising two parts—a fixation part 3 for connecting the spray head to a fluid supply system (not shown) and a distribution part 4 for distributing fluid for fire fighting according to a desired wish. The spray head further comprises an arrangement 5 for holding a fire actuation member, here a glass ampoule (not shown). Inside the glass ampoule there is a gas bubble when the ampoule is heated the gas bubble expands and breaks the glass ampoule. It can be controlled at what temperature the ampoule burst this is conventionally between 50 and 150° C. It should be noted that the fire actuation member may be implemented and configured in various ways. For example, externally positioned temperature sensors could also be used for activating the fire fighting system. Thus, the present invention should by no means be limited to any specific way of the implementing the fire actuation member.

The spray head can be made of for example brass, stainless steel or any other heat resistant material. The overall length of the spray head depicted in FIG. 1 is around 52 mm whereas the width of the spray head is around 35 mm. The spray head is designed to withstand fluidic pressures as high as 300 bar.

As seen in FIGS. 1*a* and 1*b* the distribution part 4 of the spray head comprises angled facets 9, 10 and 11 arranged in a circumferential manner around the centre axis 2. Three sets of outlet nozzles 6, 7 and 8 are arranged in respective ones of angled facets 9, 10 and 11. Thus, if a pressurised fluid, such as water, escapes through the three sets of nozzles, fluid escaping through the upper set of nozzles 6 will reach the longest distance from the spray head, whereas fluid escaping through the middle set of nozzles 7 will reach an middle distance from the spray head. Fluid escaping through the lower set of nozzles 8 will reach the shortest distance from the spray head. Fluid simultaneously escaping through all nozzles will form an essentially uniform fluid distribution in a given area on plane below the spray head in case the spray head is mounted in a ceiling of a room or building.

The upper facet 9 may, in a cross-sectional profile, form an angle of around 15° to the centre axis 2, whereas the middle facet may, in a cross-sectional profile, form an angle of around 34° to the centre axis 2. The bottom facet 11 is essentially perpendicular to the centre axis 2.

In FIG. 2 a side view of the spray head is shown in FIG. 2*a*, whereas FIG. 2*b* shows a cross-section profile along cut A-A. The spray head of FIG. 2 is connected to a fluid supply unit 12, such as a water supply unit. In addition, the spray head of FIG. 2 is depicted in a closed state in that the fire activation member 13, here a glass ampoule, is intact. The glass ampoule 13 maintains the displaceable valve element 14 in a position where the fluid conduit 15 is blocked. As seen, a fluid tight sealing is provided with sealing element 16 which can be an o-ring. A linear spring 17 biases the displaceable valve element 14 in a forward direction so that when the spray head is exposed to temperatures sufficient to burst the glass ampoule 13 the linear spring 17 displaces the valve element 14 in a forward direction whereby fluid is allowed to enter the interior 18 of the body of the spray device. From the interior 18 the fluid is allowed to escape through nozzles 19, 20 and 21. It should be noted that nozzles are also present in facet 22. However, these nozzles are not depicted in FIG. 2.

FIG. 3 shows a spray head in an open state of operation. Thus, in FIG. 3 the fluid is allowed to enter the interior 23 of the spray head via conduit 24. As seen in FIG. 3, the displaceable valve element 25 has been displaced to a front position thereby creating a free fluid passage from conduit 24 to outlet nozzles 26, 27 and 28. The pressure of the fluid may be of various sizes, but in case of water being the fluid of be distributed via the spray head a pressure of around 100 bar will be typical.

Figure 4A:
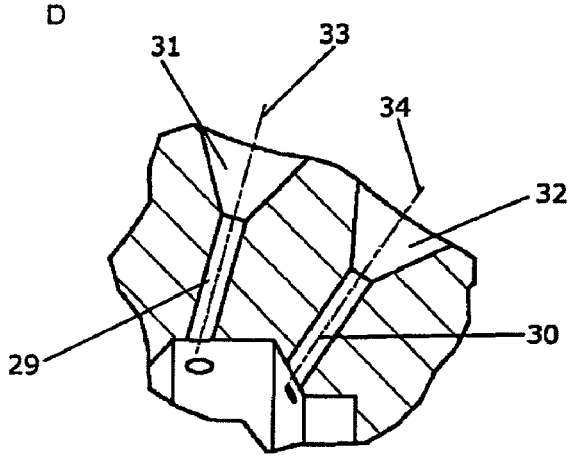
Figure 4B:
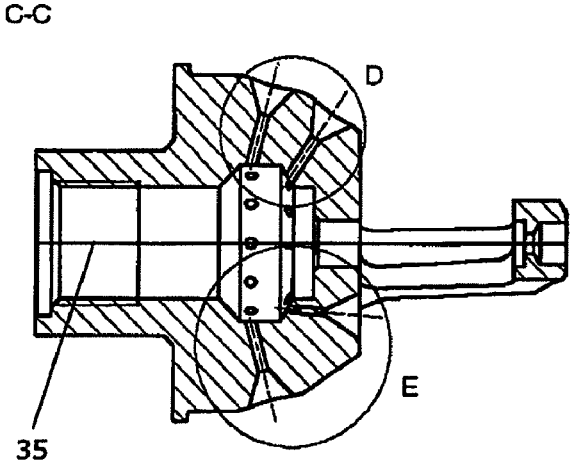
Figure 4C:
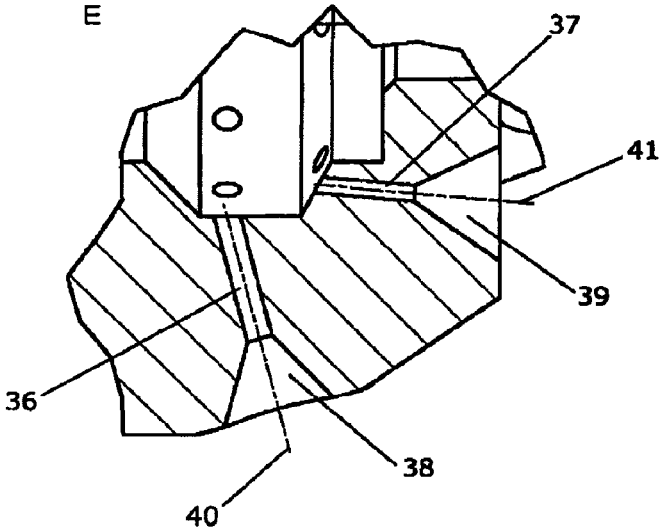

The nozzles of the spray head of the present invention is shown in greater details in FIG. 4. FIG. 4*b* shows a cross-sectional view of the spray head whereas FIGS. 4*a* and 4*c* show detailed cross-sectional views of the nozzle arrangement. Starting with FIG. 4*a* cross-sectional profiles of an upper and a middle nozzle is depicted. As seen, each nozzle has a cylindrically shaped initial passage section 29, 30 being in fluidic communication with a conically shaped expansion passage section 31, 32. The diameter of the cylindrically shaped sections 29, 30 are around 1 mm, whereas the opening angle of conically shaped sections are around 60°. The diameters of the openings of the conically shaped sections are around 4.5 mm. The respective escaping angles, indicated by axes 33, 34, measured in relation to the centre axis 35 of FIG. 4*b*, are typically around 75° for the upper nozzle 29, 31, and around 56° for the middle nozzle 30, 32. However, other escaping angles are also applicable.

Referring now to FIG. 4*c* cross-sectional profiles of an upper and a bottom nozzle is depicted. As seen, each nozzle has a cylindrically shaped initial passage section 36, 37 being in fluidic communication with a conically shaped expansion passage section 38, 39. As previously mentioned, the diameter of the cylindrically shaped section 36 of the upper nozzle is around 1 mm, whereas the diameter of the cylindrically shaped section 37 of the bottom nozzle is 0.6-0.7 mm. The opening angles of conically shaped sections are both around 60°, and the diameters of the openings of the conically shaped sections are around 4.5 mm. The respective escaping angles, indicated by axes 40, 41, measured in relation to the centre axis 35 of FIG. 4*b*, are typically around 75° for the upper nozzle 36, 38, and around 5° for the bottom nozzle 37, 39. However, as previously mentioned other escaping angles are also applicable.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A spray head comprising:

a body defining a centre axis and further comprising a first conic circumferential surface around the centre axis and a second conic circumferential surface around the centre axis, a fixation structure for fixing the spray head to a fluid supply system, a fluid inlet, a plurality of outlet nozzles comprising a first set of outlet nozzles arranged on the first conic circumferential surface around the centre axis and a second set of outlet nozzles arranged on the second conic circumferential surface around the centre axis, and a flow path between the fluid inlet and each of the plurality of outlet nozzles, wherein each of the plurality of outlet nozzles comprises an essentially identical initial passage section having a first cross sectional size and an essentially cylindrical shape, wherein each of the plurality of outlet nozzles comprises an essentially identical expansion passage section having a second cross sectional size and an essentially conical shape with a sharp end and an opening, wherein the second cross sectional size is larger than the first cross sectional size, wherein each of the sharp ends of the essentially conical shapes of the expansion passage sections is oriented towards one of the initial passage sections, wherein each of the openings of the essentially conical shapes of the expansion passage sections forms an outlet of the spray head, and wherein the first set of outlet nozzles is located at a larger radial distance from the centre axis than the second set of outlet nozzles.

2. The spray head according to claim 1, wherein the first conic circumferential surface forms a first angle to the centre axis, and wherein the second conic circumferential surface forms a second angle to the centre axis.

3. The spray head according to claim 1, wherein the first set of nozzles comprises a larger number of nozzles than the second set of nozzles.

4. The spray head according to claim 1, wherein the fixation structure surrounds the inlet.

5. The spray head according to claim 1, wherein the initial passage section is coaxially aligned with the expansion passage section.

* * * * *